US008916762B2

(12) United States Patent
Saino

(10) Patent No.: US 8,916,762 B2
(45) Date of Patent: Dec. 23, 2014

(54) TONE SYNTHESIZING DATA GENERATION APPARATUS AND METHOD

(75) Inventor: Keijiro Saino, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 695 days.

(21) Appl. No.: 13/198,613

(22) Filed: Aug. 4, 2011

(65) Prior Publication Data

US 2012/0031257 A1 Feb. 9, 2012

(30) Foreign Application Priority Data

Aug. 6, 2010 (JP) ..... 2010-177684

(51) Int. Cl.

| | |
|---|---|
| ***G10H 1/08*** | (2006.01) |
| ***G10H 7/00*** | (2006.01) |
| ***G10L 13/033*** | (2013.01) |
| ***G10H 7/10*** | (2006.01) |
| ***G10H 1/00*** | (2006.01) |
| ***G10H 5/00*** | (2006.01) |

(52) U.S. Cl.

CPC ..... *G10H 7/10* (2013.01); *G10H 2210/165* (2013.01); *G10H 2220/211* (2013.01); *G10H 2250/211* (2013.01); *G10H 2250/641* (2013.01); *G10L 13/033* (2013.01); *G10H 2250/455* (2013.01); *G10H 1/0058* (2013.01); *G10H 2240/135* (2013.01); *G10H 2250/501* (2013.01); *G10H 2210/066* (2013.01); *G10H 2240/155* (2013.01); *G10H 5/005* (2013.01)

USPC ..... 84/622

(58) Field of Classification Search

CPC ..... G10H 1/0008; G10H 2210/066; G10H 1/0058; G10H 1/06; G10H 2230/021; G10H 2240/251; G10H 1/0066; G10H 1/0091; G10H 5/007; G10H 1/24; G10H 2240/056; G10H 7/00; G10H 7/02; G10H 1/0025

USPC ..... 84/622, 659

See application file for complete search history.

(56) References Cited

U.S. PATENT DOCUMENTS 6,236,966 B1 * 5/2001 Fleming ..... 704/259
6,740,804 B2 5/2004 Kawano et al.

(Continued)

FOREIGN PATENT DOCUMENTS

JP 04-251297 A 9/1992
JP 2002-073064 A 3/2002

(Continued)

OTHER PUBLICATIONS

Notice of Grounds for Rejection (Office Action), mailed Dec. 17, 2013, for JP Patent Application No. P2010-177684, with English translation, four pages.

(Continued)

*Primary Examiner* — Jeffrey Donels

(74) *Attorney, Agent, or Firm* — Morrison & Foerster LLP

(57) ABSTRACT

For each one note or for each plurality of notes constituting a reference tone, a segment setting section segments a time series of actual pitches of the reference tone into one or more note segments. For each of the one or more note segments, a relativization section creates a time series of relative pitches that are relative values of individual ones of the actual pitches of the reference tone to a normal pitch of the note of the note segment. Information registration section stores, into a storage device, relative pitch information comprising the time series of relative pitches of each individual one of the note segments. The segment setting section may use musical score data, time-serially designating the notes of the reference tone, to set each of the note segments for each note designated by the musical score data, and may correct at least one of start and end points of each of the set note segments in response to user's operation.

25 Claims, 5 Drawing Sheets

(56) References Cited

U.S. PATENT DOCUMENTS

| | | | | |
|---|---|---|---|---|
| 6,951,977 | B1 * | 10/2005 | Streitenberger et al. | 84/626 |
| 7,732,697 | B1 * | 6/2010 | Wieder | 84/609 |
| 7,977,562 | B2 * | 7/2011 | Qian et al. | 84/622 |
| 8,115,089 | B2 * | 2/2012 | Saino et al. | 84/622 |
| 8,338,687 | B2 * | 12/2012 | Saino et al. | 84/622 |
| 8,423,367 | B2 * | 4/2013 | Saino et al. | 704/267 |
| 8,487,176 | B1 * | 7/2013 | Wieder | 84/615 |
| 2003/0094090 | A1 * | 5/2003 | Tamura et al. | 84/602 |

FOREIGN PATENT DOCUMENTS

| | | | |
|---|---|---|---|
| JP | 2002-229567 | A | 8/2002 |
| JP | 2003-345400 | A | 12/2003 |

OTHER PUBLICATIONS

Yoshimura T. et al. (Nov. 20, 2000). "Simultaneous Modeling of Spectrum, Pitch and Duration in HMM-Based Speech Synthesis," Nagoya Institute of Technology Repository, <http://repo.lib.nitech.ac.jp>, with partial English translation, p. 2100-2103, sixteen pages.

Saino, K. et al. (2006). "An HMM-based Singing Voice Synthesis System," *INTERSPEECH* 2006, pp. 1-4.

Sako, S. et al. (2008). "A Trainable Singing Voice Synthesis System Capable of Representing Personal Characteristics and Singing Styles," *IPSJ SIG Technical Report*, with English Translation, 17 pages.

* cited by examiner

TONE SYNTHESIZING DATA GENERATION APPARATUS AND METHOD

BACKGROUND

The present invention relates to techniques for synthesizing audio sounds, such as tones or voices.

As known in the art, it is possible to generate an aurally-natural tone by imparting a pitch variation characteristic, corresponding to pitch variation of an actually uttered human voice (hereinafter referred to as "reference tone"), to a tone to be synthesized. For example, a non-patent literature "A trainable singing voice synthesis system capable of representing personal characteristics and singing styles", by Shinji Sako, Keijiro Saino, Yoshihiko Nankaku, Keiichi Tokuda and Tadashi Kitamura, in study report of Information Processing Society of Japan, "Music Information Science", 2008, vol. 12, pp. 39-44, February 2008, discloses a technique for creating a probability model, representative of a time series of pitches of a reference tone, for each of various attributes (or contexts), such as pitches and lyrics and then using the created probability models for generation of synthesized tone. During the process of synthesizing a designated tone, a synthesized tone is controlled in pitch to follow a pitch trajectory identified from the probability model corresponding to the designated tone. Note that, in this specification, the term "tone" is used to collectively refer to any one of all signals of voices, sounds, tones etc. in the audible frequency range.

In fact, however, it is difficult to prepare probability models for all kinds of attributes of a designated tone. In a case where there is no probability model accurately matching an attribute of a designated tone, it is possible to create a pitch trajectory (pitch curve) using an alternative probability model close to the attribute of the designated tone in place of the probability model accurately matching the attribute of the designated tone. However, with the technique disclosed in the above-identified non-patent literature, where probability models are created through learning of numerical values of pitches of a reference tone and where learning of a pitch of a designated tone, for which an alternative probability model close to an attribute of the designated tone is used in place of a probability model accurately matching the attribute of the designated tone, is not actually executed, it is very likely that an aurally-unnatural synthesized tone would be generated.

Whereas the forgoing has described the case where a pitch trajectory is created using a probability model, an aurally-unnatural synthesized tone may also be undesirably generated in a case where numerical values of a pitch of a reference tone are stored to be subsequently used for creation of a pitch trajectory at the time of tone synthesis.

SUMMARY OF THE INVENTION

In view of the foregoing, it is an object of the present invention to generate an aurally-natural synthesized tone.

In order to accomplish the above-mentioned object, the present invention provides an improved tone synthesizing data generation apparatus, which comprises: a segment setting section which, for each one note or for each plurality of notes constituting a reference tone, segments a time series of actual pitches of the reference tone into one or more note segments; a relativization section which, for each of the one or more note segments, creates a time series of relative pitches that are relative values of individual ones of the actual pitches of the reference tone to a normal pitch of the note of the note segment; and an information registration section which stores, into a storage device, relative pitch information comprising the time series of relative pitches of each individual one of the note segments.

According to the present invention, relative pitch information comprising a time series of relative pitches, having characteristics of a time series of actual pitches of a reference tone corresponding to a given note segment, is generated as tone synthesizing data for the given note segment and stored into the storage device. Thus, the tone synthesizing data having time-varying characteristics of the actual pitches of the reference tone can be stored in a format of time-serial relative pitches and in a significantly reduced quantity of data. When such tone synthesizing data (relative pitch information) is to be used for synthesis of a tone, a normal pitch corresponding to a nominal pitch name of the designated tone is modulated in accordance with the time series of relative pitches, and thus, the present invention can create a pitch trajectory suited to vary the pitch of the designated tone over time in accordance with the tone time-varying characteristics of the actual pitches of the reference tone. As a result, the present invention can significantly reduce the quantity of the tone synthesizing data to be stored, as compared to the construction where the actual pitches of the tone synthesizing data themselves are stored and used. Further, because the characteristics of the time series of actual pitches of the reference tone can be readily reflected in the designated tone to be synthesized, the present invention can achieve the superior advantageous benefit that it can readily generate an aurally-natural synthesized tone. Thus, even where relative pitch information corresponding accurately to an attribute of a note of a tone to be synthesized is not stored in the storage device, the present invention can advantageously generate an aurally-natural synthesized tone by use of relative pitch information similar to such relative pitch information corresponding accurately to the attribute of the note of the tone to be synthesized.

The relative pitch information employed in the present invention may be of any desired content and may be created in any desired manner. For example, numerical values of relative pitches are stored as the relative pitch information in the storage device. Also, a probability model corresponding to a time series of relative pitches may be created as the relative pitch information.

For example, the tone synthesizing data generation apparatus of the present invention may further comprise: a probability model creation section which, for each of a plurality of unit segments within each of the note segments, creates a variation model defining a probability distribution (D0[*k*]) with the relative pitches within the unit segment as a random variable, and a duration length model defining a probability distribution (DL[k]) with a length of duration of the unit segment s a random variable. In this case, the information registration section may store, as the relative pitch information, the variation model and the duration length model created by the probability model creation section. Because a probability model indicative of the time series of relative pitches is stored in the storage device, the present invention can even further reduce the size of the relative pitch information as compared to the construction where numerical values of relative values themselves are used as the relative pitch information.

The note segments may be set in any desired manner. For example, the tone synthesizing data generation apparatus may further comprise a musical score acquisition section which acquires musical score data time-serially designating notes of the reference tone, and the segment setting section may set the one or more note segments for each of the notes designated by the musical score data. However, because segments of individual notes of the reference tone and segments of notes indicated by the musical score data may sometimes not completely coincide with each other, it is particularly preferable to set a note segment per note indicated by the musical score data and then correct at least one of start and end points of each of the thus-set note segments. For example, the segment setting section may set provisional note segments in correspondence with lengths of the individual notes designated by the musical score data and formally set the note segments by correcting at least one of start and end points of the provisional note segments.

According to another aspect of the present invention, there is provided an improved pitch trajectory creation apparatus, which comprises: a storage device which, for each of a plurality of note segments corresponding to a plurality of notes of different attributes, relative pitch information comprising a time series of relative pitches of the note, the time series of relative pitches representing a time series of actual pitches of a reference tone in relative values to a normal pitch defined by a nominal note of the reference tone; and a trajectory creation section which selects, from the storage device, the relative pitch information corresponding to a designated note, modulates a normal pitch corresponding to the designated note in accordance with the time series of relative pitches included in the selected relative pitch information and thereby creates a pitch trajectory indicative of a time-varying pitch of the designated note.

According to the present invention, the relative pitch information corresponding to the designated note is selected from the storage device, the normal pitch corresponding to the designated note is modulated in accordance with the time series of relative pitches included in the selected relative pitch information, and thus, a pitch trajectory indicative of a time-varying pitch of the designated note can be created. Therefore, as compared to the construction where the actual pitches of the reference tone themselves are stored and used, the data quantity of the pitch trajectory to be stored can be reduced. Further, because the characteristics of the time series of the actual pitches of the reference tone can be readily reflected in the designated tone to be synthesized, the present invention can achieve the superior advantageous benefit that it can readily generate an aurally-natural synthesized tone. Thus, even where relative pitch information corresponding accurately to an attribute of a note of a tone to be synthesized is not stored in the storage device is not stored in the storage device, the present invention can advantageously generate an aurally-natural synthesized tone by use of relative pitch information similar to such relative pitch information corresponding accurately to an attribute of the note of the tone to be synthesized.

As an example, the relative pitch information includes, for each of a plurality of unit segments within each of the note segments, a variation model defining a probability distribution (D0[*k*]) with the relative pitches within the unit segment as a random variable, and a duration length model defining a probability distribution (DL[k]) with a length of duration of the unit segment as a random variable. The trajectory creation section creates, for each unit segment of which length of duration has been determined in accordance with the duration length model, creates the pitch trajectory in accordance with an average of the probability distribution represented by the variation model corresponding to the unit segment and a normal pitch corresponding to the designated note.

For example, in a case where the relative pitches are designated in a scale of logarithmic values of frequencies, a pitch trajectory of the designated note is created using, as a probability distribution of the pitch of the designated note, a sum between an average of a probability model indicated by the variation model and the pitch corresponding to the designated note. Note that variations to be applied by the pitch creation section to creation of a pitch trajectory are not limited to the average of the probability model indicated by the variation model and the pitch corresponding to the designated pitch. For example, a variance of the probability model indicated by the variation model (i.e., tendency of the entire distribution) may also be taken into account for creation of a pitch trajectory.

The present invention may be embodied not only as the above-described tone synthesizing data generation apparatus but also as an audio synthesis apparatus using the pitch trajectory creation apparatus. The audio synthesis apparatus of the present invention may include, in addition to the aforementioned, a tone signal generation section for generating a tone signal having a pitch varying over time in accordance with the pitch trajectory.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

<First Embodiment>

Figure 1:
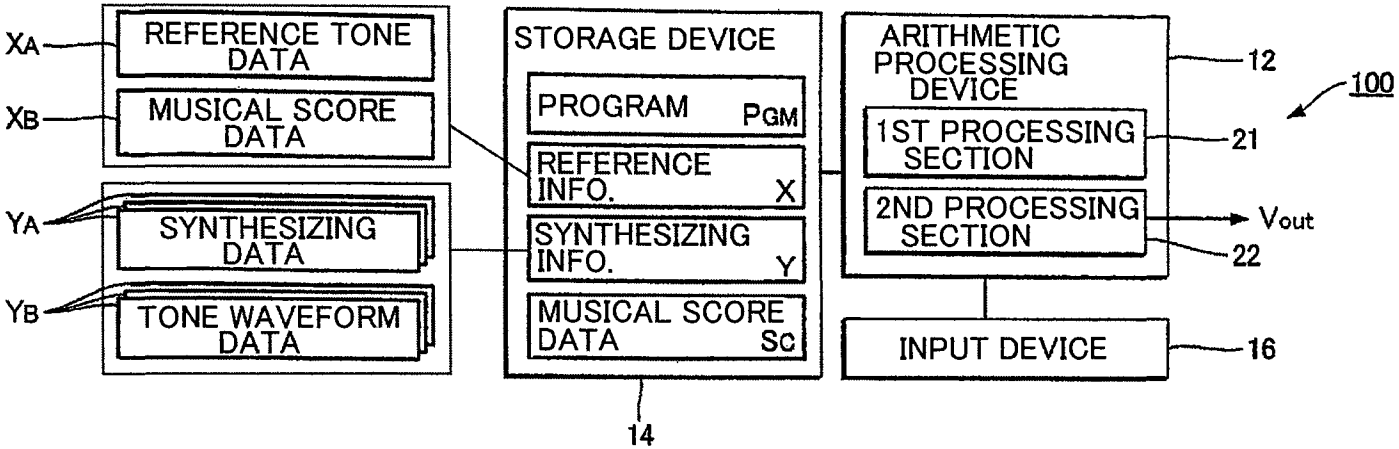
FIG. 1 is a block diagram showing an example construction of a first embodiment of an audio synthesis apparatus of the present invention.

FIG. 1 is a block diagram showing an example construction of a first embodiment of an audio synthesis apparatus 100 of the present invention. The first embodiment of the audio synthesis apparatus 100 is a singing voice synthesis apparatus for generating or creating synthesized tone data Vout indicative of a singing voice or tone of a music piece comprising desired notes and lyrics. As shown FIG. 1, the first embodiment of an audio synthesis apparatus 100 is implemented by a computer system including an arithmetic processing device 12, a storage device 14 and an input device 16. The input device 16 is, for example, in the form of a mouse and keyboard, which receives instructions given from a user.

The storage device 14 stores therein programs PGM for execution by the arithmetic processing device 12 and various data (such as reference information X, synthesizing information Y and musical score data SC) for use by the arithmetic processing device 12. A conventional recording medium, such as a semiconductor recording medium or magnetic recording medium, or a combination of a plurality of such conventional types of recording media is used as the storage device 14.

The reference information X is a database including reference tone data XA and musical score data XB. The reference tone data XA is a series of waveform samples, in the time domain, of a voice with which a particular singing person (or singer) sang a singing music piece; such a voice will hereinafter referred to as "reference tone", and such a singing person will hereinafter referred to as "reference singing person". The musical score data XB is data representative of a musical score of the music piece represented by the reference tone data XA. Namely, the musical score data XB time-serially designates notes (i.e., pitch names and lengths of duration) and lyrics (i.e., words to be sung, or letters and characters to be sounded) of the reference tone.

The synthesizing information Y is a database including a plurality of synthesizing data YA and a plurality of tone waveform data YB. Different synthesizing information Y is created for each of various reference singing persons, or for each of various genres of singing music pieces sung by the reference singing persons. Different synthesizing data YA is created for each of attributes (such as pitch names and lyrics) of singing tones and represents variation over time of a pitch or time-varying pitch (hereinafter referred to as "pitch trajectory") as a singing expression unique to the reference singing person. Each of the synthesizing data YA is created in accordance with a time series of pitches extracted from the reference tone data XA, as will be described later. Each of the tone waveform data YB is created in advance per phoneme uttered by the reference singing person and represents waveform characteristics (such as shapes of a waveform and frequency spectrum in the time domain) of the phoneme.

The musical score data SC time-serially designates notes (pitch names and lengths of duration) and lyrics (letters and characters to be sounded) of tones to be synthesized. The musical score data SC is created in response to user's instructions (i.e., instructions for creating and editing the musical score data SC) given via the input device 16. Roughly speaking, synthesized tone data Vout is created by the tone waveform data YB, corresponding to notes and lyrics of tones sequentially designated by the musical score data SC, being processed so as to follow the pitch trajectory indicated by the synthesizing data YA. Therefore, each reproduced tone of the synthesized tone data Vout is a synthesized tone reflecting therein a singing expression (pitch trajectory) unique to the reference singing person.

The arithmetic processing device 12 performs a plurality of functions (i.e., functions of first and second processing sections 21 and 22) necessary for creation of the synthesized tone data Vout (tone synthesis), by executing the programs PGM stored in the storage device 14. The first processing section 21 creates the individual synthesizing data YA of the synthesizing information Y using the reference information X, and the second processing section 22 creates the synthesized tone data Vout using the synthesizing information Y and musical score data SC. Note that the individual functions of the arithmetic processing device 12 may be implemented by dedicated electronic circuitry (DSP), or by a plurality of distributed integrated circuits.

Figure 2:
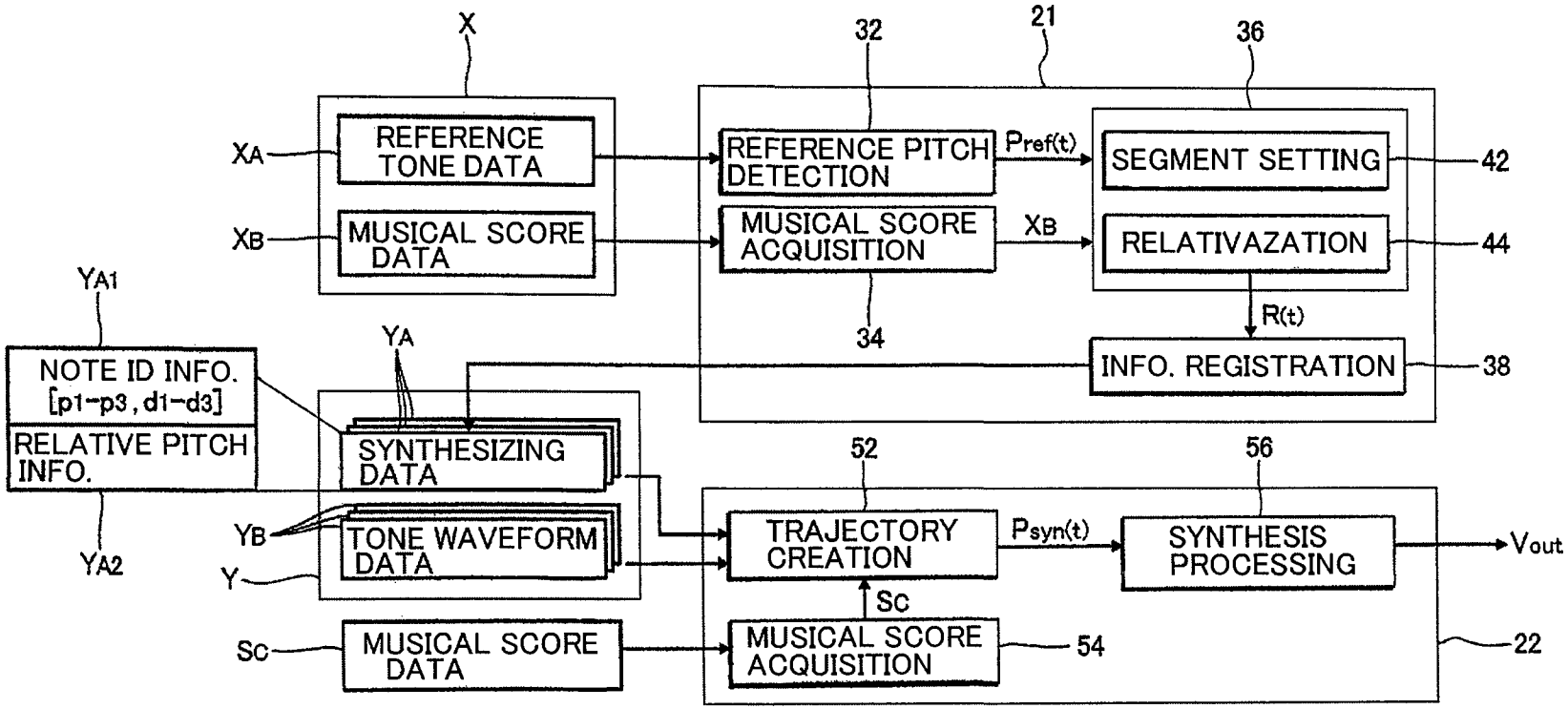
FIG. 2 is a block diagram of first and second processing sections provided in the first embodiment of the audio synthesis apparatus.

FIG. 2 is a block diagram of the first and second processing sections 21 and 22. In FIG. 2, there are also shown the reference information X, reference information X, synthesizing information Y and musical score data SC stored in the storage device 14. As shown in FIG. 2, the first processing section 21 includes a reference pitch detection section 32, a musical score acquisition section 34, a synthesizing data creation section 36 and an information registration section 38.

The reference pitch detection section 32 of FIG. 2 sequentially detects actual pitches of a reference tone (hereinafter referred to as "reference pitches") Pref(t) of the reference tone indicated or represented by the reference tone data XA. The individual reference pitches (fundamental frequencies) Pref (t) are time-serially detected for each of frames obtained by segmenting, on the time axis, the reference tone indicated by the reference tone data XA. Letter "t" represents a frame number. Detection of the reference pitches Pref(t) is performed using a conventionally-known technique.

Figure 3:
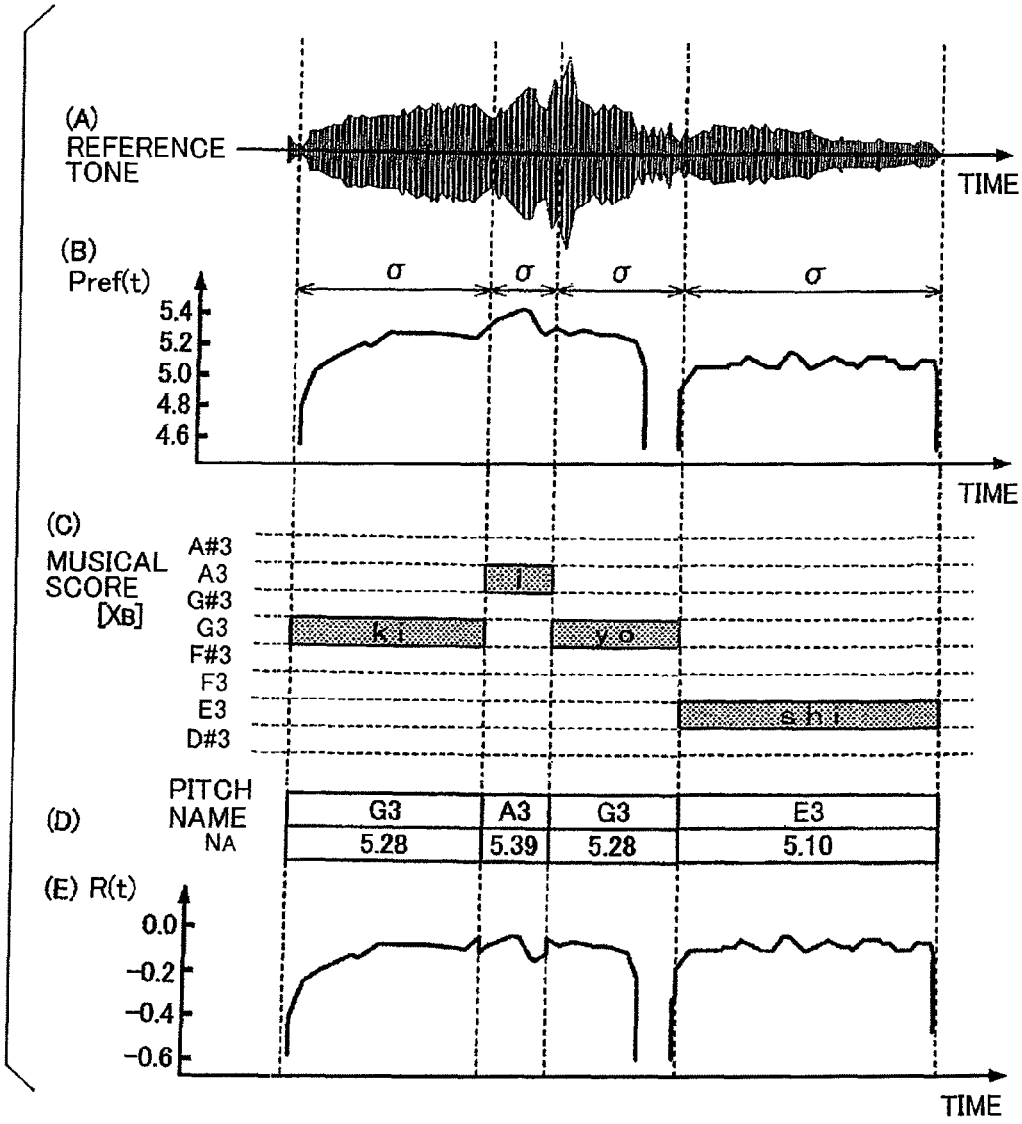
FIG. 3 is a diagram explanatory of behavior of the first processing section provided in the first embodiment.

FIG. 3 shows, on a common or same time axis, a waveform of the reference tone indicated by the reference tone data XA (section "(A)" in FIG. 3) and a time series of the reference pitches Pref(t) detected by the reference pitch detection section 32 ("(B)" in FIG. 3). The reference pitches Pref(t) shown in FIG. 3 are logarithmic values of frequencies (Hz). Note that, for a section of the reference tone where there is no harmonic structure (i.e., a section corresponding to a consonant where no pitch is detected), the reference pitch is set at a predetermined value (e.g., an interpolated value between values of the reference pitches Pref(t) immediately preceding and succeeding the no-harmonic-structure section).

The musical score acquisition section 34 of FIG. 2 acquires, from the storage device 14, the musical score data XB corresponding to the reference tone data XA. In section (C) of FIG. 3, a time series (indicated in a piano roll format) of the reference pitches Pref(t) designated by the tone waveform data YB is shown on the same time axis as the waveform of the reference tone shown in section (A) and the time series of the reference pitches Pref(t) shown in section (B) of FIG. 3.

The synthesizing data creation section 36 of FIG. 2 generates or creates a plurality of reference tone data XA of the synthesizing information Y using the time series of reference pitches Pref(t) detected by the reference pitch detection section 32 and musical score data XB acquired by the musical score acquisition section 34. As shown in FIG. 2, the synthesizing data creation section 36 includes a segment setting section 42 and a relativization section 44.

The segment setting section 42 divides or segments the time series of reference pitches Pref(t), detected by the reference pitch detection section 32, into a plurality of segments (i.e., hereinafter referred to as "note segments"), in correspondence with nominal notes designated by the musical score data XB. In other words, for each one note or for each plurality of notes constituting the reference tone, the segment setting section 42 segments the time series of actual pitches of the reference tone into one or more note segments. More specifically, as shown in section (B) and section (C) of FIG. 3, the time series of the reference pitches Pref(t) is segmented into a plurality of note segments σ using, as boundaries, the start and end points of each of the notes designated by the musical score data XB. In section (D) of FIG. 3 are shown pitch names (G3, A3, . . . ) of the notes corresponding to the note segments σ and pitches NA corresponding to the pitch names.

The relativization section 44 of FIG. 2 creates a time series of relative pitches R(t) of each frame from the reference pitches Pref(t) time-serially detected by the reference pitch detection section 32 on a frame-by-frame basis. In section (E) of FIG. 3 is shown the time series of relative pitches R(t). The relative pitches R(t) are relative values of the reference pitches Pref(t) to a normal pitch NA defined by a nominal pitch name of a note designated by the musical score data XB. Namely, in the case where the reference pitches Pref(t) are designated in the scale of logarithmic values of frequencies (Hz) as noted above, the relative pitch R(t) is calculated by subtracting, from each of the reference pitches Pref(t) within one note segment σ, the pitch NA corresponding to the pitch name of the note segment σ in question (thus, a same or common value to all of the reference pitches Pref(t) within the note segment σ). For example, for the note segment σ corresponding to the note for which the pitch name "G3" is designated by the musical score data XB, the relative pitch R(t) of each of the frames is calculated by subtracting the pitch NA (NA=5.28) corresponding to the pitch name "G3" from each of the reference pitches Pref(t) within the note segment σ, as defined by Mathematical Expression (1) below.

$$R(t)=\mathrm{Pref}(t)-NA \tag{1}$$

Note that the relative pitch R(t) may be determined as a ratio Pref(t)/NA rather than as the above-mentioned difference.

The information registration section 38 of FIG. 2 stores, into the storage device 14, a plurality of synthesizing data YA each representative of a time series of relative pitches R(t) within each of the note segments σ. Such synthesizing data YA is created per note segment σ (i.e., per note). As shown in FIG. 2, the synthesizing data YA includes note identification (ID) information YA1 and relative pitch information YA2. The relative pitch information YA2 in the first embodiment represents a time series of relative pitches R(t) calculated for the note segment σ by the relativization section 44.

The note identification information YA1 is an identifier identifying attributes of a note (hereinafter referred to also as "object note") which are indicated by individual synthesizing data YA, and the note identification information YA1 includes variables p1-p3 and variables d1-d3. The variable p2 is set at a pitch name (note number) of the object note, the variable p1 is set at a musical interval of a note immediately preceding the object note (i.e., set at a value relative to the pitch name of the object note), and the variable p3 is set at a musical interval of a note immediately succeeding the object note. The variable d2 is set at a length of duration of the object note, the variable d1 is set at a length of duration of the note immediately preceding the object note, and the variable d3 is set at a length of duration of the note immediately succeeding the object note. The reason why the synthesizing data YA is created per attribute of a note is that the pitch trajectory of the reference tone varies in accordance with the musical intervals and lengths of duration of the notes immediately preceding and succeeding the object note. Note that the attributes of the object note are not limited to the aforementioned. For example, any desired information influencing the pitch trajectory of the singing voice or tone, such as information indicating to which beat (first beat, second beat, . . . ) within a measure of the music piece the object note corresponds and/or information indicating at which position (e.g., forward or rearward position) in a time period corresponding to one breath of the reference tone the object note is, can also be designated, as the attributes of the object note, by the note identification information YA1.

The second processing section 22 of FIG. 2 creates synthesized tone data Vout using the synthesizing information Y created in the aforementioned manner. The second processing section 22 starts creation of the synthesized tone data Vout, for example, in response to a user's instruction given via the input device 16. As shown in FIG. 2, the second processing section 22 includes a trajectory creation section 52, a musical score acquisition section 54 and a synthesis processing section 56. The musical score acquisition section 54 acquires, from the storage device 14, musical score data SC designating a time series of notes of synthesized tones.

The trajectory creation section 52 creates, from each of the synthesizing data YA, a time series of pitches (hereinafter referred to as "synthesized pitches") Psyn(t) of a tone designated by the musical score data SC acquired by the musical score acquisition section 54. More specifically, the trajectory creation section 52 sequentially selects, on a designated-tone-by-designated-tone basis, synthesizing data YA (hereinafter referred to as "selected synthesizing data YA"), corresponding to tones designated by the musical score data SC, of the plurality of synthesizing data YA stored in the storage device 14. More specifically, for each of the designated tones, synthesizing data YA of which attributes (variables p1-p3 and variables d1-d3) indicated by the note identification information YA1 are close to or match attributes of the designated tone (i.e., pitch names and lengths of duration of the designated tone and notes immediately preceding and succeeding the designated tone) is selected as the selected synthesizing data YA.

Further, the trajectory creation section 52 creates a time series of synthesized pitches Psyn(t) on the basis of the relative pitch information YA2 (time series of relative pitches R(t)) of the selected synthesizing data YA and pitch NB corresponding to the pitch name of the designated tone. More specifically, the trajectory creation section 52 expands or contracts (performs interpolation or thinning-out on) the time series of relative pitches R(t) of the relative pitch information YA2 so as to correspond to the length of duration of the designated tone, and then calculates a synthesized pitch Psyn (t) per frame by adding the normal pitch NB, corresponding to the pitch name of the designated tone, to each of the relative pitches R(t) (i.e., modulating the normal pitch NB with each of the relative pitches R(t)) as defined by Mathematical Expression (2) below. Namely, the time series of synthesized pitches Psyn(t) created by the trajectory creation section 52 approximates a pitch trajectory with which the reference singing person sang the designated tone.

$$P\mathrm{syn}(t)=R(t)+NB \tag{2}$$

Note that the modulation of the normal pitch NB may be by multiplication rather than the aforementioned addition.

The synthesis processing section (tone signal generation section) 56 of FIG. 2 creates synthesized tone data Vout of a singing voice or tone whose pitch varies over time so as to follow the time series of synthesized pitches Psyn(t) (i.e., pitch trajectory) generated by the trajectory creation section 52. More specifically, the synthesis processing section 56 creates synthesized tone data Vout by acquiring, from the storage device 14, waveform data YB corresponding to lyrics of individual designated tones indicated by the musical score data SC and processing the acquired waveform data YB in such a manner that the pitch varies over time in accordance with the time series of synthesized pitches Psyn(t). Thus, a reproduced tone of the synthesized tone data Vout represents a singing tone imparted with a singing expression (pitch trajectory) unique to the reference singing person.

In the above-described first embodiment, relative pitch information YA2 of the synthesizing data YA is created and stored in accordance with the relative pitches R(t) of the pitch Pref(t) of the reference tone to the pitch NA of the note of the reference tone, and a time series of synthesized pitches Psyn (t) (pitch trajectory of a synthesized tone) is created on the basis of the time series of relative pitches R(t) indicated by the relative pitch information YA2 and the pitch NB corresponding to the pitch name of the designated tone. Thus, the instant embodiment can synthesize an aurally-natural singing voice as compared to the construction where the time series of reference pitches Pref(t) is stored as the synthesizing data YA and where synthesized tone data Vout is created so as to follow the time series of reference pitches Pref(t).

<Second Embodiment>

Next, a description will be given about a second embodiment of the present invention. Elements similar in operation and function to those in the first embodiment are represented by the same reference numerals and characters as used for the first embodiment, and a detailed description of such similar elements will be omitted as appropriated to avoid unnecessary duplication.

Figure 4:
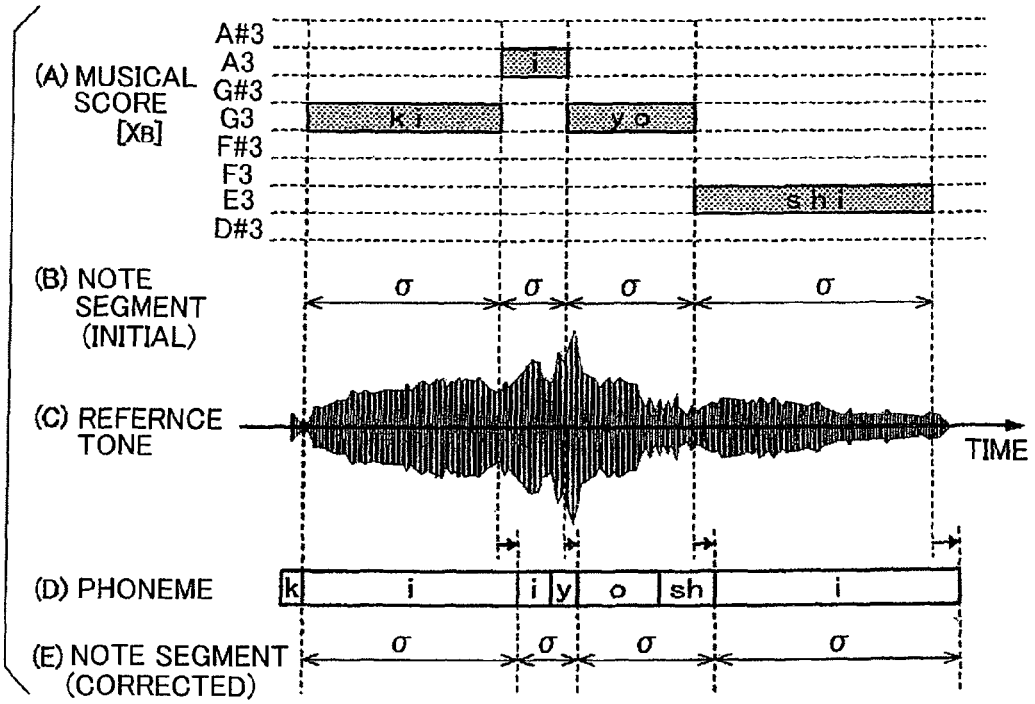
FIG. 4 is a diagram explanatory of behavior of a segment setting section provided in a second embodiment of the audio synthesis apparatus.

FIG. 4 is a diagram explanatory of behavior of the segment setting section 42 provided in the second embodiment. Section (A) of FIG. 4 shows time series of notes and lyrics indicated by musical score data XB, and section (B) of FIG. 4 shows note-specific note segments (provisional note segments) σ initially segmented in accordance with the musical score data XB. Section (C) of FIG. 4 shows a waveform of a reference tone represented by reference tone data XA. The segment setting section 42 corrects the note-specific provisional note segments σ of the musical score data XB. Section (E) of FIG. 4 shows corrected note-specific note segments σ. The segment setting section 42 corrects the note segments σ, for example, in response to a user's instruction given via the input device 16.

In section (D) of FIG. 4, there are shown boundaries between individual phonemes of the reference tone. As understood from a comparison between sections (A) and (D) of FIG. 4, start points of the individual notes indicated by the musical score data XB and start points of the individual phonemes of the reference tone do not completely coincide with each other. The segment setting section 42 corrects the note segments σ (section (B) of FIG. 4) in such a manner that each of the corrected note segments σ (section (E) of FIG. 4) corresponds to a corresponding one of the phonemes of the reference tone.

More specifically, the segment setting section 42 not only displays, on a display device (not shown), the waveform of the reference tone (section (C) of FIG. 4) and the initial (i.e., uncorrected) note segments σ (section (B) of FIG. 4), but also audibly generates or sounds the reference tone via a sounding device (not shown). The user estimates and then designates, via the input device 16, start and end points of phonemes of vowels or Japanese syllabic nasals ("ん") of the reference tone by visually comparing the waveform of the reference tone and the individual note segments σ while listening to the sounded reference tone. The segment setting section 42 corrects the starts points of the individual initial note segments σ (section (B) of FIG. 4) to coincide with the start points of the phonemes of user-designated vowels or Japanese syllabic nasals as shown in section (E) of FIG. 4. Further, the segment setting section 42 corrects the end point of each note segment σ succeeded by no note (i.e., immediately succeeded by a rest) to coincide with the end point of a corresponding one of the phonemes of vowels or Japanese syllabic nasals. The individual note segments σ having been corrected by the segment setting section 42 are applied to creation, by the relativization section 44, of relative pitches R(t).

Note that the setting (or correction), by the segment setting section 52, of the note segments σ may be performed in any desired manner. Whereas the segment setting section 42 has been described as automatically set the individual note segments σ in such a manner that segments of phonemes of vowels or Japanese syllabic nasals, designated by the user, coincide with the note segments σ, the note segments σ may be corrected, for example, in by the user operating the input device 16 in such a manner that the segments of the phonemes of vowels or Japanese syllabic nasals coincide with the note segments σ.

The second embodiment constructed in the above-described manner can achieve the same advantageous benefits as the first embodiment. Further, because the note segments σ set in the reference tone are corrected in the second embodiment in the aforementioned manner, the second embodiment can segment the reference tone on a note-by-note basis with a high accuracy even where the individual notes represented by the musical score date XB do not completely coincide with the corresponding notes of the reference tone. Thus, the second embodiment can effectively prevent an error of the relative pitches R(t) that would result from time lags or differences between the notes represented by the musical score date XB and the notes of the reference tone.

<Third Embodiment>

Next, a description will be given about a third embodiment of the present invention. Whereas the first embodiment of the audio synthesis apparatus 100 has been described above as storing a time series of relative pitches R(t), created by the relativization section 44, into the storage device 14 as the relative pitch information YA2 of the synthesizing data YA, the third embodiment stores a probability model, representative of a time series of relative pitches R(t), into the storage device 14 as the relative pitch information YA2.

Figure 5:
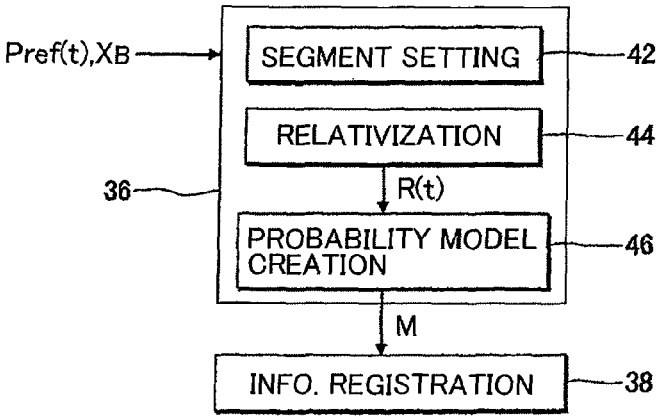
FIG. 5 is a block diagram of a synthesizing data creation section provided in a third embodiment of the audio synthesis apparatus.

FIG. 5 is a block diagram of the synthesizing data creation section 36 provided in the third embodiment. The synthesizing data creation section 36 provided in the third embodiment includes the segment setting section 42 and the relativization section 44 similarly to the synthesizing data creation section 36 provided in the first embodiment, but it is different from the first embodiment in that it includes a probability model creation section 46. For each of attributes of notes of a reference tone, the probability model creation section 46 creates, as the relative pitch information YA2, a probability model M representative of a time series of relative pitches R(t) generated by the relativization section 44. The information registration section 38 creates, for each of the notes, synthesizing data YA by adding note identification information YA1 to the relative pitch information YA2 created by the probability model creation section 46 and stores the thus-created synthesizing data YA into the storage device 14.

Figure 6:
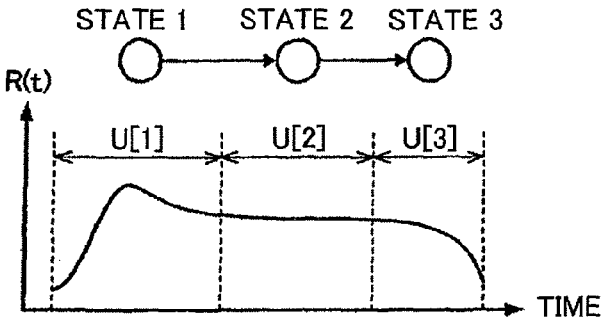
FIG. 6 is a diagram explanatory of processing performed in the third embodiment for creating relative pitch information.
Figure 7:
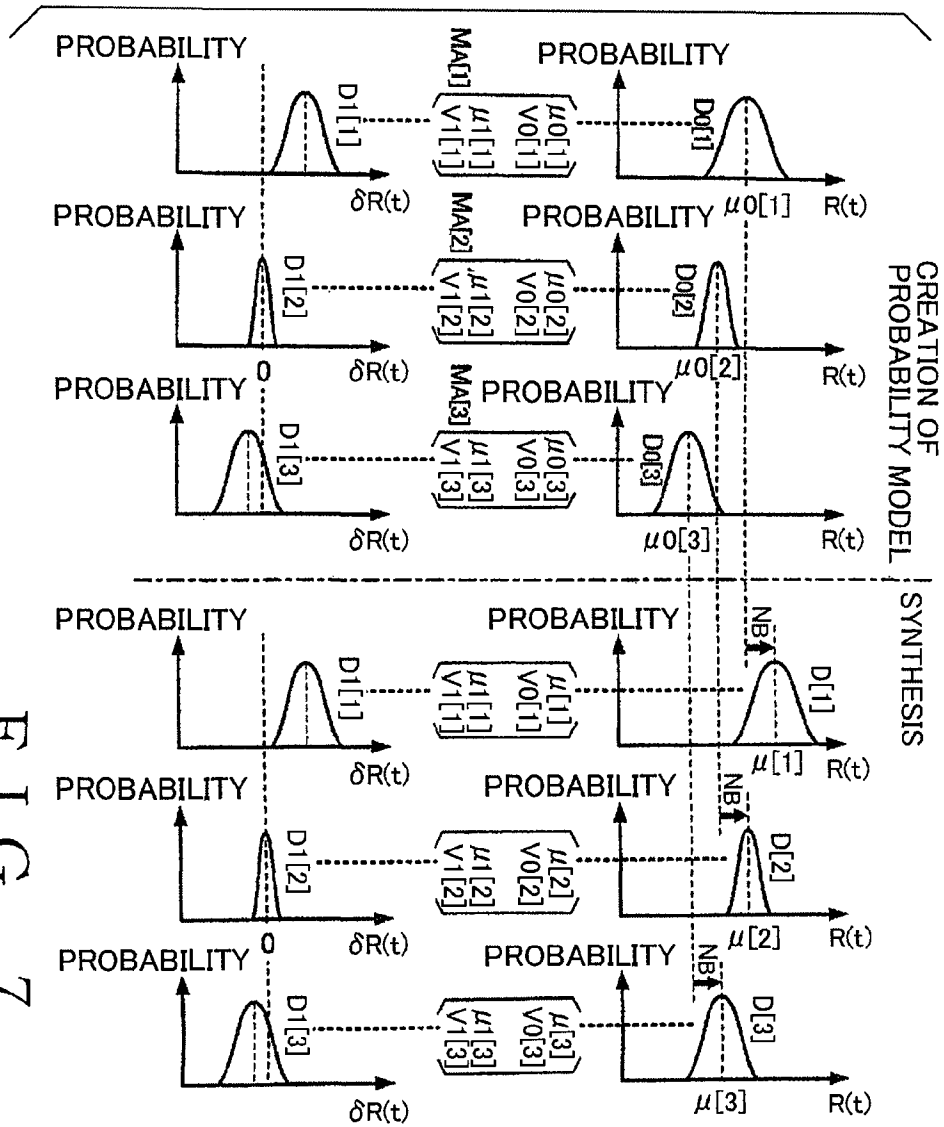
FIG. 7 is also a diagram explanatory of the processing performed in the third embodiment for creating relative pitch information.
Figure 8:
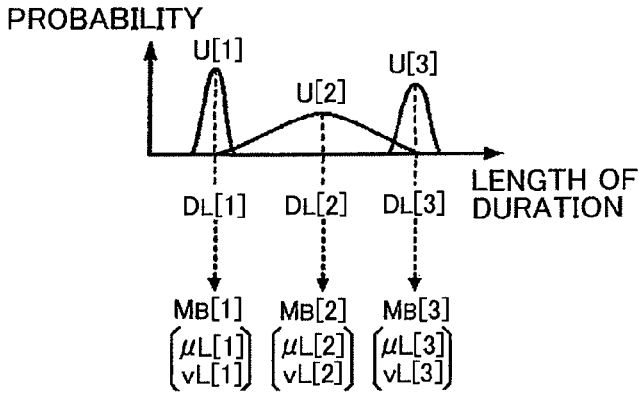
FIG. 8 is also a diagram explanatory of the processing performed in the third embodiment for creating relative pitch information.

FIGS. 6 to 8 are diagrams explanatory of processing performed by the probability model creation section 46 for creating a probability model M. In FIG. 6, an HSMM (Hidden Semi Markov Model) defined by K (K is a natural number) states is illustratively shown as a probability model M corresponding to one note segment σ. The probability model M is defined by K variation models MA[1]-MA[K] of FIG. 7 indicative of probability distributions (output distributions) of relative pitches R(t) in the individual states, and K duration length models MB[1]-MB[K] of FIG. 8 indicative of probability distributions of lengths of duration (i.e., duration length distributions) of the individual states. Note that any other suitable probability model than the HSMM may be employed as the probability model M.

As shown in FIG. 6, the time series of relative pitches R(t) within each of the note-specific note segments σ set by the segment setting section 42 is segmented into K unit segments U[1]-U[K] corresponding to the individual states of the probability model M. In the illustrated example of FIG. 6, the number K of the states is three.

As shown in FIG. 7, the variation model MA[k] of the k-th state of the probability model M represents (defines): a probability distribution of the relative pitches R(t) (i.e., probability density function with the relative pitch R(t) as a random variable) D0[*k*] within the unit segment U[k] in the time series of relative pitches R(t); and a probability distribution D1[*k*] of variation over time (differential value) δR(t) of the relative pitches R(t) within the unit segment U[k]. More specifically, normal distributions are used as the probability distribution D0[*k*] of the relative pitches R(t) and probability distribution D1[*k*] of variation over time (differential value) δR(t) of the relative pitches R(t). The variation model MA[k] defines an average value μ0[*k*] and variance v0[*k*] of the probability distribution D0[*k*] of the relative pitches R(t) and an average value μ1[*k*] and variance v1[*k*] of the probability distribution D1[*k*] of variation over time δR(t). Note that there may be employed an alternative construction where the variation model MA[k] defines a probability distribution of second-order differential values of the relative pitches R(t) in addition to the above-mentioned relative pitches R(t) and variation over time δR(t).

The duration length model MB[k] of the k-th state, as shown in FIG. 8, represents (defines) a probability distribution of lengths of duration (i.e., probability density function with the length of duration of the unit segment U[k] as a random variable) DL[k] of the relative pitches R(t) within the unit segment U[k] in the time series of relative pitches R(t). More specifically, the duration length model MB[k] defines an average μL[k] and variance vL[k] of the probability distribution (e.g., normal distribution) of the lengths of duration DL[k].

The probability model creation section 46 of FIG. 5 performs a learning process (maximum likelihood estimation algorithm) on the time series of relative pitches R(t) to determine a variation model MA[k] (μ0[*k*], v0[*k*], μ1[*k*], v1[*k*]) and duration length model MB[k] (μL[k], vL[k]) for each of the K states, and creates, as the relative pitch information YA2 for each of the note segments σ (for each of the notes), a probability model M including variation models MA[1]-MA[k] and duration length models MB[1]-MB[k]. More specifically, the probability model creation section 46 creates a probability model M of the note segment σ such that the time series of relative pitches R(t) within the note segment σ appears with the greatest probability.

The trajectory creation section 52 provided in the third embodiment creates a time series of synthesized pitches Psyn (t) by use of the relative pitch information YA2 (probability model M) of the selected synthesizing data YA, corresponding to a designated tone indicated by the musical score data SC, of the plurality of synthesizing data YA. First, the trajectory creation section 52 segments each designated tone, whose length of duration is designated by the musical score data SC, into K unit segments U[1]-U[K]. The length of duration of each of the unit segments U[k] is determined in accordance with the probability distribution DL[k] indicated by the duration length model MB[k] of the selected synthesizing data YA.

Second, the trajectory creation section 52 calculates an average μ[k] on the basis of the average μ0[*k*] of the probability distribution D0[*k*] of the relative pitches R(t) of the variation models MA[k] and a pitch NB corresponding to a pitch name of the designated tone, as shown in FIG. 7. More specifically, as defined by Mathematical Expression (3) below, a sum between the average μ0[*k*] of the probability distribution D0[*k*] and the pitch NB of the designated tone is calculated as the average μ[k]. Namely, the probability distribution D[k] of FIG. 7, defined by the average μ[k] calculated by Mathematical Expression (3) and a variance v0[*k*] of the variation model MA[k], corresponds to a probability distribution of pitches within the unit segment U[k] occurring when the reference singing person sang the designated tone, and it reflects therein a singing expression (pitch trajectory) unique to the reference singing person.

$$\mu[k]=\mu 0[k]+NB \tag{3}$$

Third, the trajectory creation section 52 calculates a time series of synthesized pitches Psyn(t) within each of the unit segments U[k] such that a joint probability between 1) the above-mentioned probability distribution D[k] defined by the average μ[k] calculated by Mathematical Expression (3) above and the variance v0[*k*] of the variation models MA[k] and 2) the above-mentioned probability distribution D1[*k*] defined by the average μ1[*k*] and variance v1[*k*] of the variation over time δR(t) of the variation model MA is maximized. Thus, as in the first embodiment, the time series of synthesized pitches Psyn(t) approximates a pitch trajectory with which the reference singing person sang the designated tone. Further, the synthesis processing section 56 creates synthesized tone data Vout using the time series of synthesized pitches Psyn(t) and tone waveform data YB corresponding to lyrics of the designated tone, as in the first embodiment.

The third embodiment too can achieve the same advantageous benefits as the first embodiment. Further, the third embodiment, where a probability model M representing a time series of relative pitches R(t) is stored in the storage device 14 as the relative pitch information YA2, can significantly reduce the size of the synthesizing data YA and hence the required capacity of the storage device 14, as compared to the first embodiment where the time series of relative pitches R(t) itself is stored as the relative pitch information YA2. Note that the aforementioned construction of the second embodiment for correcting the note segments u may be applied to the third embodiment as well.

<Modification>

The above-described embodiments may be modified variously as exemplified below, and any two or more of the following modifications may be combined as desired.

(1) Modification 1:

Whereas the above-described embodiments are each constructed to segment the time series of reference pitches Pref(t) into a plurality of note segments σ by use of the musical score data XB, a modification may be made such that the segment setting section 42 sets each note segment σ using, as boundaries, time points designated by the user via the input device 16 (i.e., without using the musical score data XB for setting the note segment σ). For example, the user may designate each note segment σ by appropriately operating the input device 16 while visually checking the waveform of the reference tone displayed on the display device but also listening to the reference tone audibly generated or sounded via the sounding device (e.g., speaker). Thus, in this modification, the musical score acquisition section 34 may be dispensed with.

(2) Modification 2:

Whereas the above-described embodiments are each constructed in such a manner that the reference pitch detection section 32 detects reference pitches Pref(t) from the reference tone data XA stored in the storage device 14, a modification may be made such that a time series of reference pitches Pref(t) detected in advance from the reference tone is stored in the storage device 14. Thus, in this modification, the reference pitch detection section 32 may be dispensed with.

(3) Modification 3:

Whereas the above-described embodiments of the audio synthesis apparatus 100 include both the first processing section 21 and the second processing section 22, the present invention may be embodied as a tone synthesizing data generation apparatus including only the first processing section 21 for creating synthesizing data YA, or as an audio synthesis apparatus including only the second processing section 22 for generating synthesized tone data Vout by use of the synthesizing data YA stored in the storage device 14. Further, an apparatus including the storage device 14 storing therein the synthesizing data YA and the trajectory creation section 52 of the second processing section 22 may be embodied as a pitch trajectory creation apparatus for creating a time series of synthesized pitches Psyn(t) (pitch trajectory).

(4) Modification 4:

Further, whereas each of the above-described embodiments is constructed to synthesize a singing voice or tone, the application of the present invention is not limited to synthesis of singing tones. For example, the present invention is also applicable to synthesis of tones of musical instruments in a similar manner to the above-described embodiments.

This application is based on, and claims priority to, JP PA 2010-177684 filed on 6 Aug. 2010. The disclosure of the priority application, in its entirety, including the drawings, claims, and the specification thereof, are incorporated herein by reference.

What is claimed is:

1. A tone synthesizing data generation apparatus comprising:

a segment setting section which segments a time series of actual pitches of a reference tone sequence into one or more note segments, the one or more note segments corresponding to one or more nominal notes constituting the reference tone sequence;

a relativization section which, for each of the one or more note segments, creates a time series of relative pitches that are relative values of individual ones of the actual pitches of the reference tone to a normal pitch of the note of the note segment; and an information registration section which stores, into a storage device, relative pitch information comprising the time series of relative pitches of each individual one of the note segments.

2. The tone synthesizing data generation apparatus as claimed in claim 1, which further comprises:

a probability model creation section which, for each of a plurality of unit segments within each of the note segments, creates a variation model defining a probability distribution (D0[*k*]) with the relative pitches within the unit segment as a random variable, and a duration length model defining a probability distribution (DL[k]) with a length of duration of the unit segment as random variable, and wherein said information registration section stores, as the relative pitch information, the variation model and the duration length model created by said probability model creation section.

3. The tone synthesizing data generation apparatus as claimed in claim 2, wherein the variation model further defines a probability distribution (D1[*k*]) of differential values of the relative pitches within the unit segment.

4. The tone synthesizing data generation apparatus as claimed in claim 3, wherein the variation model further defines a second-order differential value of the relative pitches within the unit segment.

5. The tone synthesizing data generation apparatus as claimed in claim 1, which further comprises a musical score acquisition section which acquires musical score data time-serially designating the nominal notes of the reference tone sequence, and wherein said segment setting section sets the one or more note segments for each of the nominal notes designated by the musical score data.

6. The tone synthesizing data generation apparatus as claimed in claim 5, wherein said segment setting section sets provisional note segments in correspondence with lengths of individual ones of the nominal notes designated by the musical score data and formally sets the note segments by correcting at least one of start and end points of the provisional note segments.

7. The tone synthesizing data generation apparatus as claimed in claim 6, wherein said segment setting section corrects at least one of the start and end points of the provisional note segments in response to user's operation.

8. The tone synthesizing data generation apparatus as claimed in claim 1, which further comprises an input device operable by a user for designating time points to segment the time series of actual pitches of the reference tone sequence, and wherein said segment setting section sets the one or more note segments using, as boundaries, time points designated by the user via the input device.

9. The tone synthesizing data generation apparatus as claimed in claim 1, wherein said information registration section stores note identification information, identifying an attribute of the note of each of the note segments, into the storage device together with the relative pitch information.

10. The tone synthesizing data generation apparatus as claimed in claim 9, wherein the note identification information includes: information identifying the note of the note segment; information identifying a musical interval of the note of the note segment relative to a note of an immediately preceding note segment; information identifying a musical interval of the note of the note segment relative to a note of an immediately succeeding note segment; information identifying a length of duration of the note segment; information identifying a length of duration of the immediately preceding note segment; and information identifying a length of duration of the immediately succeeding note segment.

11. The tone synthesizing data generation apparatus as claimed in claim 1, wherein the reference tone sequence is a singing voice of a particular person.

12. The tone synthesizing data generation apparatus as claimed in claim 1, which further comprises:

an information acquisition section which acquires information designating a note to be synthesized; and a pitch trajectory creation section which selects, from the storage device, the relative pitch information corresponding to the note designated by the information acquired by said information acquisition section, modulates a normal pitch of the designated note in accordance with the time series of relative pitches included in the selected relative pitch information and thereby creates a pitch trajectory indicative of a time-varying pitch of the note to be synthesized.

13. The tone synthesizing data generation apparatus as claimed in claim 12, wherein the information acquired by said information acquisition section includes data designating a length of duration of the designated note, and said pitch trajectory creation section expands or contracts a time length of the time series of relative pitches, included in the selected relative pitch information, in accordance with the data designating the length of duration and thereby creates the pitch trajectory having an expanded or contracted time length.

14. The tone synthesizing data generation apparatus as claimed in claim 12, wherein said information acquisition section acquires, on the basis of musical score data, information designating a plurality of notes to be sequentially synthesized.

15. The tone synthesizing data generation apparatus as claimed in claim 12, which further comprises a tone signal generation section which generates a tone signal having a pitch varying over time in accordance with the pitch trajectory.

16. The pitch trajectory creation apparatus as claimed in claim 12, wherein the relative pitch information includes, for each of a plurality of unit segments within each of the note segments, a variation model defining a probability distribution (D0[$k$]) with the relative pitches within the unit segment as a random variable, and a duration length model defining a probability distribution (DL[k]) with a length of duration of the unit segment as a random variable, and said pitch trajectory creation section creates, for each unit segment of which length of duration has been determined in accordance with the duration length model, creates the pitch trajectory in accordance with an average of the probability distribution represented by the variation model corresponding to the unit segment and a normal pitch corresponding to the designated note.

17. A pitch trajectory creation apparatus comprising:

a storage device which, for each of a plurality of note segments corresponding to a plurality of nominal notes of different attributes, relative pitch information comprising a time series of relative pitches, the time series of relative pitches representing a time series of actual pitches of a reference tone in relative values to a normal pitch defined by a nominal note of the reference tone; and a trajectory creation section which selects, from the storage device, the relative pitch information corresponding to a designated note, modulates a normal pitch corresponding to the designated note in accordance with the time series of relative pitches included in the selected relative pitch information and thereby creates a pitch trajectory indicative of a time-varying pitch of the designated note.

18. The pitch trajectory creation apparatus as claimed in claim 17, which further comprises:

an information acquisition section which acquires information designating a note to be synthesized, the information acquired by said information acquisition section including data designating a length of duration of the designated note, and wherein said pitch trajectory creation section expands or contracts a time length of the time series of relative pitches, included in the selected relative pitch information, in accordance with the data designating the length of duration and thereby creates the pitch trajectory having an expanded or contracted time length.

19. The pitch trajectory creation apparatus as claimed in claim 18, wherein said information acquisition section acquires, on the basis of musical score data, information designating a plurality of notes to be sequentially synthesized.

20. The pitch trajectory creation apparatus as claimed in claim 17, which further comprises a tone signal generation section which generates a tone signal having a pitch varying over time in accordance with the pitch trajectory.

21. The pitch trajectory creation apparatus as claimed in claim 17, wherein the relative pitch information includes, for each of a plurality of unit segments within each of the note segments, a variation model defining a probability distribution (D0[$k$]) with the relative pitches within the unit segment as a random variable, and a duration length model defining a probability distribution (DL[k]) with a length of duration of the unit segment as a random variable, and said trajectory creation section creates, for each unit segment of which length of duration has been determined in accordance with the duration length model, creates the pitch trajectory in accordance with an average of the probability distribution represented by the variation model corresponding to the unit segment and a normal pitch corresponding to the designated note.

22. A computer-implemented method for generating tone synthesizing data, said method comprising:

a step of segmenting a time series of actual pitches of a reference tone sequence into one or more note segments, the one or more note segments corresponding to one or more nominal notes constituting the reference tone sequence;

a step of, for each of the one or more note segments, creating a time series of relative pitches that are relative values of individual ones of the actual pitches of the reference tone sequence to a normal pitch of the note of the note segment; and a step of storing, into a storage device, relative pitch information comprising the time series of relative pitches of each individual one of the note segments.

23. A computer-readable storage medium containing a group of instructions for causing a computer to perform a method for generating tone synthesizing data, said method comprising:

a step of segmenting a time series of actual pitches of a reference tone sequence into one or more note segments, the one or more note segments corresponding to one or more nominal notes constituting the reference tone sequence;

a step of, for each of the one or more note segments, creating a time series of relative pitches that are relative values of individual ones of the actual pitches of the reference tone sequence to a normal pitch of the note of the note segment; and a step of storing, into a storage device, relative pitch information comprising the time series of relative pitches of each individual one of the note segments.

24. A computer-implemented method for creating a pitch trajectory, said method comprising:

a step of accessing a storage device storing therein, for each of a plurality of note segments corresponding to a plurality of nominal notes of different attributes, relative pitch information comprising a time series of relative pitches, the time series of relative pitches representing a time series of actual pitches of a reference tone in relative values to a normal pitch defined by a nominal note of the reference tone;

a step of selecting, from the storage device, the relative pitch information corresponding to a designated note, in response to access to the storage device;

a step of modulating a normal pitch corresponding to the designated note in accordance with the time series of relative pitches included in the selected relative pitch information and thereby creating a pitch trajectory indicative of a time-varying pitch of the designated note.

25. A computer-readable storage medium containing a group of instructions for causing a computer to perform a method for creating a pitch trajectory, said method comprising:

a step of accessing a storage device storing therein, for each of a plurality of note segments corresponding to a plurality of nominal notes of different attributes, relative pitch information comprising a time series of relative pitches, the time series of relative pitches representing a time series of actual pitches of a reference tone in relative values to a normal pitch defined by a nominal note of the reference tone;

a step of selecting, from the storage device, the relative pitch information corresponding to a designated note, in response to access to the storage device;

a step of modulating a normal pitch corresponding to the designated note in accordance with the time series of relative pitches included in the selected relative pitch information and thereby creating a pitch trajectory indicative of a time-varying pitch of the designated note.

* * * * *